US006739260B2

(12) United States Patent
Damme et al.

(10) Patent No.: US 6,739,260 B2
(45) Date of Patent: May 25, 2004

(54) METHOD FOR THE PREPARATION OF A NEGATIVE WORKING PRINTING PLATE

(75) Inventors: Marc Van Damme, Bonheiden (BE); Johan Loccufier, Zwijnaarde (BE)

(73) Assignee: Agfa-Gevaert, Mortsel (BE)

( * ) Notice: Subject to any disclaimer, the term of this patent is extended or adjusted under 35 U.S.C. 154(b) by 39 days.

(21) Appl. No.: 10/131,717

(22) Filed: Apr. 24, 2002

(65) Prior Publication Data

US 2003/0005838 A1 Jan. 9, 2003

Related U.S. Application Data

(60) Provisional application No. 60/293,384, filed on May 23, 2001.

(30) Foreign Application Priority Data

May 17, 2001 (EP) ..... 01000150

(51) Int. Cl.[7] ..... B41C 1/10

(52) U.S. Cl. ..... 101/465; 101/457; 101/462; 347/96

(58) Field of Search ..... 101/457, 458, 101/459, 462, 463.1, 465, 466; 347/95, 96, 100

(56) References Cited

U.S. PATENT DOCUMENTS

| | | | | | |
|---|---|---|---|---|---|
| 5,292,556 | A | * | 3/1994 | Ma et al. | 427/264 |
| 5,312,654 | A | * | 5/1994 | Arimatsu et al. | 427/511 |
| 5,466,653 | A | * | 11/1995 | Ma et al. | 503/200 |
| 5,695,908 | A | * | 12/1997 | Furukawa | 430/205 |
| 6,131,514 | A | * | 10/2000 | Simons | 101/466 |
| 6,187,380 | B1 | * | 2/2001 | Hallman et al. | 427/261 |
| 6,526,886 | B2 | * | 3/2003 | Loccufier et al. | 101/466 |

FOREIGN PATENT DOCUMENTS

| | | | |
|---|---|---|---|
| EP | 0 720 054 | A | 7/1996 |
| EP | 1072956 | * | 1/2001 |
| GB | 1431462 | * | 4/1976 |
| GB | 2 082 976 | A | 3/1982 |
| JP | 10-202822 | * | 8/1998 |
| JP | 11-245364 | * | 9/1999 |
| WO | 97 21146 | A | 6/1997 |
| WO | 97 39894 | A | 10/1997 |
| WO | 98 42507 | A | 10/1998 |

OTHER PUBLICATIONS

Research Disclosure 289118 "Ink Jet Recording For Use in Making Lithographic Printing Plates", De brabandere et al., pp. 351–352, May 1988.*

* cited by examiner

*Primary Examiner*—Stephen R. Funk
(74) *Attorney, Agent, or Firm*—Joseph T. Guy; Nexsen Pruet, LLC

(57) ABSTRACT

A method for the preparation of a negative working lithographic printing plate by means of ink jet printing is disclosed. This method uses a lithographic printing plate precursor comprising a lithographic support and an image forming layer containing a polymeric binder soluble in an aqueous alkaline developer. The precursor is image-wise printed by an ink jet fluid comprising a compound capable of reducing the solubility of the binder in the aqueous alkaline developer. After development a negative working printing plate is obtained.

17 Claims, No Drawings

METHOD FOR THE PREPARATION OF A NEGATIVE WORKING PRINTING PLATE

The application claims the benefit of Provisional Application No. 60/293,384 filed May 23, 2001.

FIELD OF THE INVENTION

The present invention relates to a method for the preparation of a lithographic printing plate by ink jet printing using a particular type of ink jet fluid.

BACKGROUND OF THE INVENTION

Traditional techniques of printing include letterpress printing, gravure printing and offset lithography. All of these printing methods require a plate, usually loaded onto a plate cylinder of a rotary press for efficiency, to transfer ink in the pattern of the image. In letterpress printing, the image pattern is represented on the plate in the form of raised areas that accept ink and transfer it onto the recording medium by impression. Gravure printing cylinders, in contrast, contain series of wells or indentations that accept ink for deposit onto the recording medium.

In the case of traditional offset lithography the image to be printed is present on a plate as a pattern of ink accepting (oleophilic) areas on an ink repellent (oleophobic or hydrophilic) background. In the wet system the required ink repellency is provided by an initial application of a dampening (or "fountain) solution prior to inking. Conventional presensitized lithographic printing plates bear a UV sensitive coating based on photopolymer or diazonium chemistry. The plates have to be UV-exposed through a mask carrying the image. The mask is a graphic arts film prepared by photographic techniques based on silver halide chemistry and involving exposure by a camera or by an image-setter, and further involving wet processing. Depending on the type of plate used (negative or positive) the non-image areas or the image areas are solubilized thereby differentiating the plate into oleophilic and hydrophilic areas. A disadvantage of this traditional method is the necessary cumbersome preparation of the photographic intermediate film involving wet processing. A further drawback is the wet processing of the printing plate itself.

With the advent of the computer in revolutionizing the graphics design process leading to printing, there have been extensive efforts to develop a convenient and inexpensive computer-to-plate system wherein a photographic intermediate is no longer required. In recent years some of these systems are introduced into the market based on different chemical systems and exposure methods. For instance, the SETPRINT material, trade mark of Agfa-Gevaert N.V. is based on silver halide DTR chemistry and consists of a polyethylene terephthalate base carrying a photographic coating which after photo-mode exposure and processing produces complementary oleophilic and hydrophilic areas. Another system based on photo-mode exposure but with a hydrophilic aluminum base is LITHOSTAR, trade mark of Agfa-Gevaert N.V. A system based on heat mode exposure by means of an intense infra-red laser is called THERMOSTAR, also a trade mark of Agfa-Gevaert N.V.

Many of the new computer-to-plate system are large, complex, and expensive. They are designed for use by large printing companies as a means to streamline the prepress process of their printing operations and to take advantage of the rapid exchange and response to the digital information of graphics designs provided by their customers. There remains a strong need for an economical and efficient computer-to-plate system for the many smaller printers who utilize lithographic printing. A number of electronic, non-impact printing systems have been investigated for use in making lithographic printing plates to satisfy the needs of these smaller printers. Foremost among these have been laser printing systems, for example as described in U.S. Pat. No. 5,304,443 and references therein. Another non-impact printing system which has received attention for economical and convenient computer-to-plate preparation for lithographic printing is thermal transfer printing, for example, as described in U.S. Pat. No. 4,958,564.

In recent years, ink jet printers have replaced laser printers as the most popular hard copy output printers for computers. Some of the competitive advantages of ink jet printers are low cost and reliability. The ink jet printing system is a relatively rapid image output system and has a simple construction because it does not require any complex optical system. In recent times, there have been some reports in the literature proposing the use of ink jet printers to make lithographic printing plates.

In Japanese Kokai 62-25081, an oleophilic liquid or fluid ink was printed by ink jet printing onto a hydrophilic aluminum surface of a lithographic printing plate. Titanate or silane coupling agents were present in the ink.

An ink jet printing apparatus to make lithographic printing plates is described in PCT WO 94/11191. It is directed to depositing hydrophobic or hydrophilic substances on hydrophobic printing plates.

In U.S. Pat. No. 5,501,150, a fluid ink and hydrophilic media set containing materials to produce a silver-reducible image by ink jet printing are used to make a metallic silver image which, following wet processing to make the silver image sufficiently hydrophobic, is said to provide a lithographic printing plate.

Ink jet printing wherein the ink is a solid or phase change type ink instead of a liquid or fluid type ink is described in U.S. Pat. No. 4,833,486 to deposit a hot wax on a surface of an offset plate. Upon cooling of the wax, it solidifies, thereby providing a printing plate. Solid ink jet printing has serious disadvantages for lithographic plates in that the wax or resin image has limited durability due to its thermoplastic, chemical, and adhesive properties and the amount and rounded shape of the solidified ink jet droplet on the media do not have the intrinsic image resolution properties found in liquid ink jet printing.

There is also prior art in the use of ink jet printing to apply an opaque image or mask pattern to a photosensitive lithographic printing plate blank, as for example, in Japanese.Kokai 63-109,052. The blank is then exposed through the ink jet imaged mask pattern and then processed by conventional means to provide a lithographic printing plate. This approach retains the materials and processing of conventional lithographic printing plates and only uses ink jet printing as an alternative for the photomask through which the conventional plates are exposed. Thus this approach adds to the complexity and expense of the platemaking process and does not depend on the ink jet ink image for the hydrophobic image of the plate. U.S. Pat. No. 5,495,803 describes a solid or phase change type of ink jet printing to form a photomask for a printing plate.

As a further example of the methods for preparing printing plates by using the ink jet printing system, Japanese Kokai Publication 113456/1981 proposes methods for preparing printing plates whereby ink-repelling materials (e.g. curable silicones) are printed on a printing plate by ink jet printing. The printing plate obtained by this method is an intaglio printing plate in which the ink-repelling material formed on the surface of the substrate serves as a non-image part. As a result, the resolution of the printed images at shadow area or reversed lines is not so good. Moreover, a large amount of ink is needed in this method because the ink-repelling material must be deposited on the whole non-image part which occupies most of the surface of the printing plate, thereby delaying the printing process.

U.S. Pat. No. 5,511,477 discloses a method for the production of photopolymeric relief-type printing plates comprising: forming a positive or a negative image on a substrate by ink jet printing with a photopolymeric ink composition, optionally preheated to a temperature of about 30°–260° C., and subjecting the resulting printed substrate to UV radiation, thereby curing said ink composition forming said image. This is an obnoxious method due to the sometimes high vapour pressure and toxicity of said inks.

U.S. Pat. No. 5,312,654 discloses a method for making lithographic printing plates comprising: forming an image on a substrate having an ink absorbing layer and a hydrophilized layer between the substrate and the absorbing layer by ink jet printing using a photopolymerizable ink composition, and exposing it to an actinic light in the wavelength region with which said ink composition is sensitized to cure the image. The printing endurance of said printing plates is low.

Japanese Kokai Publication 69244/1992 discloses a method for making printing plates comprising the steps of forming a printed image on a recording material subjected to a hydrophilic treatment by ink jet printing using a hydrophobic ink containing photocurable components, and exposing the whole surface to actinic light. However, the surface of the substrate to be used for the lithographic plate is usually subjected to various treatments such as a mechanical graining, an anodizing or a hydrophilic treatment to obtain good hydrophilic property and water retention property. Therefore, even the use of an ink composition having a very high surface tension results in a poor image on the surface of the substrate because of ink spreading and low printing endurance.

EP-A-533 168 discloses a method for avoiding said ink spreading by coating the lithographic base with an ink absorbing layer which is removed after ink printing. This is an uneconomical and cumbersome method.

Research Disclosure 289118 of May 1988 discloses a method for making printing plates with the use of an ink jet wherein the ink is is a hydrophobic polymer latex. However said printing plates have a bad ink acceptance and a low printing endurance.

EP-A-003 789 discloses a process for the preparation of offset printing plates by means of an ink jet method with oleophilic inks. There is not indicated how said inks are made but from the examples it is clear that it concerns artificial latices, which are difficult to prepare.

JN-57/038142 discloses a method of preparing a printing plate by forming an ink image on a blank printing plate, and also by fixing this image thermally by making toner to adhere to this image-formed area. The composition of the ink is not mentioned, only the composition of the toners is disclosed.

JN-07/108667 discloses a plate-making method forming an ink image containing a hydrophilic substance on a conductive support whose surface layer is made hydrophilic according to an electrostatic attraction type ink set system to dry or cure the same, by applying bias voltage to the conductive support at the time of ink jet writing. This is a cumbersome process.

U.S. Pat. No. 5,213,041 discloses a method for preparing a reusable printing plate for printing, projecting an imaging deposit on the plate surface by jet printing using an ejectable substance containing a heat fusible component. The image forms an imaging deposit which is fused to the surface of the printing plate using a variable frequency and variable power induction heater.

According to WO 97/43122 a lithographic printing plate is manufactured by means of an ink jet fluid comprising reactive components selected from the group consisting of transition metal complexes and organic carbonyl compounds. In a preferred embodiment the reactive compound comprises one or more chromium complexes of an organic acid.

In WO 00/46034 a printable media is disclosed, including a substrate having a hydrophilic, porous layer on at least one surface, and an ink receptive, thermoplasic image layer adhered to the hydrophilic, porous layer, wherein the ink receptive layer contains a polymer having a low surface energy and a plurality of tertiary amine sites being at least partially neutralized with an acid. Further a method is disclosed wherein the polymer having tertiary amine sites is applied in a fluid by means of ink jet printing onto the hydrophilic porous layer. A similar fluid is disclosed in WO 00/46038.

In WO 97/39894 a heat-sensitive composition is disclosed and a method of making a lithographic printing form with it. On a lithographic base there is coated a complex of preferably a phenolic resin and a compound which forms a thermally frangible complex with the phenolic resin. This complex is less soluble in the developer solution than the uncomplexed phenolic resin. Further a laser absorbing material can be present. When the complex is image-wise heated, e.g. by high-power IR-irradiation, the complex breaks down so allowing the non-complexed phenolic resin to be dissolved in the developing solution. A positive working printing form is obtained. This teaching is further elaborated in WO 98/42507 wherein specific dissolution inhibitors are disclosed.

In EP 864420 there is provided a heat-sensitive imaging element for making positive working lithographic printing plates comprising on a lithographic base a layer comprising a polymer, soluble in an aqueous alkaline solution and an IR-sensitive top layer. Upon image-wise exposure the capacity of the aqueous alkaline solution to penetrate or solubilize the top layer is changed.

The lithographic printing plate precursors based on heat mode according to the above cited references show the drawback that they require a complicated and expensive platesetter apparatus equipped with an an expensive and short-living high power IR exposure unit. Furtheron their working mode is limited to positive working.

The presents invention provides an alternative to the teachings on heat-sensitive lithographic printing plate precursors.

OBJECTS OF TRE INVENTION

It is an object of the present invention to provide a method for the preparation of a lithographic printing plate that is negative working.

It is a further object of the present invention to provide a is method for the preparation of a lithographic printing plate which is uncomplicated and requires only a relatively cheap ink jet printer.

It is still a further object of the present invention to provide a method for the preparation of a lithographic printing plate whereby the whole process can be performed in a daylight environment.

It is still a further object of the present invention to provide a method for the preparation of a lithographic printing plate which has the same plate and lithographic characteristics as a conventional printing plate.

SUMMARY OF THE INVENTION

The above mentioned objects are realised by providing a method for the preparation of a negative working lithographic printing plate, said method comprising the following steps, in order, (1) providing a lithographic printing plate precursor comprising a lithographic support and an image forming layer containing a polymeric binder soluble in an aqueous alkaline developer, (2) dispensing image-wise by means of ink jet printing droplets of a fluid onto the surface of said lithographic printing plate precursor, characterized in that said fluid comprises in a solvent carrier a dissolution inhibitor compound capable of reducing the solubility in said aqueous alkaline developer of said polymeric binder, (3) drying the imaged lithographic printing plate precursor to at least partially remove the solvent carrier of the fluid, (4) treating the dried imaged lithographic printing plate precursor with an aqueous alkaline developer thereby removing the non-imaged areas.

The final result is a negative working printing plate with the plate characteristics of a conventional plate. Preferentially the imaging layer does not contain photochemical compounds, which might influence the aqueous alkaline developer solubility of the binder upon UV-exposure. In that case the whole process can be carried in a daylight environment, without the need for safelight conditions.

DETAILED DESCRIPTION OF THE INVENTION

The essential elements of the present invention being the composition of the ink jet fluid and of the printing plate precursor will now be explained in detail.

Composition of the Ink Jet Fluid

The novel ink jet fluid used in accordance with the present invention comprises a liquid carrier and at least one compound capable or reducing the solubility of the polymeric binder of the image forming layer in an aqueous alkaline developer. This compound will furtheron also be called 'dissolution inhibitor compound'. Such 'dissolution inhibitor compounds' are known from e.g. WO 98/42507. These compounds have polar functionality that serve as acceptor sites for hydrogen bonding with hydroxyl groups on aromatic rings. The acceptor sites are atoms with high electron density, preferably selected from electronegative first row elements. Useful polar groups include keto groups (including vinylogous esters). Other groups may also be useful, such as sulfones, sulfoxides, thiones, phosphine oxides, nitrites, imides, amides, thiols, ethers, alcohols, ureas as well as nitroso, azo, azoxy, nitro and halo groups. In general, it is desired that such compounds have an "inhibition factor" of at least about 0.5, and preferably at least about 5 and more preferably, at least about 15. The higher this value is, the more useful is the compound in this invention.

Inhibition factors for given compounds can be readily measured using the procedure described by Shih et al, Macromolecules, Vol. 27, p. 3330 (1994). The inhibition factor is the slope of the line obtained by plotting the log of the development rate as a function of inhibitor concentration in the coated layer. Development rates are conveniently measured by laser interferometry, as described by Meyerhofer in IEEE Trans. Electron Devices, ED-27,921 (1980).

Representative compounds having the desired properties reported dissolution (inhibition factors listed in parentheses) include aromatic ketones including, but not limited to, xanthones (2.26), flavanones (6.80), flavones (18.3), 2,3-diphenyl-1-indenones (23.6), pyrones (including thiopyrones), and 1'-(2'-acetonaphthonyl)benzoate, and include such compounds as α- and β-naphthoflavone (49.1 and 46.6, respectively), 2,6-diphenyl-4H-pyran-4-one, 2,6-diphenylpyrone, 2,6-diphenylthiopyrone, 2,6-di-t-butylthiopyrone and 2,6-diphenyl-4H-thiopyran-4-one. The flavones and pyrones are preferred, including but not limited to, α-naphthoflavone, 2,6-diphenyl-4H-pyran-4-one and 2,6-diphenyl-4H-thiopyran-4-one.

Other classes of dissolution inhibitor compounds are disclosed in WO/39894, also called "reversible insolubiliser compounds", in this reference.

A useful class of reversible insolubiliser compounds are nitrogen-containing compounds wherein a least one nitrogen atom is either quaternized, incorporated in a heterocyclic ring or quaternized and incorporated in a heterocyclic ring. Examples of useful quaternized nitrogen containing compounds are triaryl methane dyes such as Crystal Violet (CI basic violet 3) and Ethyl Violet, Flexo Blue 630 (a commercially available triarylmethane dye from BASF AG) and tetraalkyl ammonium compounds.

More preferably the reversible insolubiliser compound is a nitrogen-containing heterocyclic compound. Examples of suitable nitrogen-containing heterocyclic compounds are quinoline and triazoles, such as 1,2,4-triazole.

Most preferably the reversible insolubiliser compound is a quarternized heterocyclic compound. Examples of suitable quarternized heterocyclic compounds are imidazolinium compounds, such as MONAZOLINE C, MONAZOLINE 0, MONAZOLINE CY and MONAZOLINE T, all trade names of Mona Industries, quinolinium compounds, such 1-ethyl-2-methyl quinolinium iodide and 1-ethyl-4-methyl quinolinium iodide, and benzothiazolium compounds, such as 3-ethyl-2-methyl benzothiazolium iodide, and pyridinium compounds, such as cetyl pyridinium bromide, ethyl viologen dibromide and fluoropyridinium tetrafluoroborate.

Usefully the quinolinium or benzothiazolium compounds are cationic cyanine dyes, such as Dye A (see formula below), Quinoldine Blue and 3-ethyl-2-[3-(3-ethyl-2(3H)-benzothiazolylidene)-2-methyl-1-propenyl] benzothiazolium iodide.

Dye A

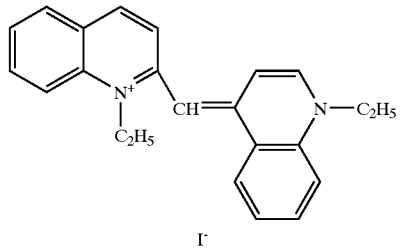

A further useful class of reversible insolubiliser compounds are carbonyl functional group containing compounds. Examples of suitable carbonyl containing compounds are a-naphthoflavone, -naphthoflavone, 2,3-diphenyl-1-indeneone, flavone, flavanone, xanthone, benzophenone, N-(4-bromobutyl)phthalimide and phenanthrenequinone.

The reversible insolubilising compound may be a compound of general formula $Q_1S(0)_nQ_2$, wherein $Q_1$ represents an optionally substituted phenyl or alkyl group, n represents 0, 1 or 2, and $Q_2$ represents a halogen atom or an alkoxy group. Preferably $Q_1$ represents a $C_{1-4}$ alkyl phenyl group, for example a tolyl group, or a $C_{1-4}$ alkyl group. Preferably n represents 1 or, especially, 2. Preferably $Q_2$ represents a chlorine atom or a $C_{1-4}$ alkoxy group, especially an ethoxy group.

Another useful reversible insolubiliser compound is acridine orange base (CI Solvent Orange 15).

Other useful reversible insolubiliser compounds are ferrocenium compounds, such as ferrocenium hexafluorophosphate.

The "dissolution inhibitor compound" may be present in the ink in an amount from 0.01 to 10, preferably from 0.01 to 8% by weight.

It is necessary that the "dissolution inhibitor compound" be in the form of a homogeneous solution or a stable colloidal dispersion, so that it can pass through the jets of the printer head.

The liquid carrier is water or organic solvents or combinations thereof. Choice of the specific liquid carrier depends on the specific ink jet printer and its compatible with the ink jet printing head and cartridge being used for the ink jet printing. Both aqueous based and solvent based inks can be used in the present invention depending on the ink-jet technology that is being used: piezo, thermal, bubble jet or continuous ink jet.

The liquid carrier can be a solvent for the imaging layer or it can be a mixture of a solvent and a non-solvent. In order to get a good interaction between the insolubilizer and the polymer, soluble in the aqueous alkaline developer, the liquid carrier should at least partially contain a solvent capable of dissolving or swelling the imaging layer.

While water is the preferred medium for aqueous inks, the aqueous composition may comprise one or more water miscible solvents e.g. a polyhydric alcohol such as ethylene glycol, diethylene glycol, triethylene glycol or trimethylol propane. Such polyhydric alcohols function as so-called humectants preventing the ink from drying out in the orifices of the print head. The amount of aqueous carrier medium in the aqueous composition may be in the range from 30 to 99.995, preferably from 50 to 95% by weight. Also organic solvents may be used as a carrier medium for the ink e.g. alcohols, ketones or acetates.

As known for the ink jet technology, the jet velocity, separation length of the droplets, drop size and stream stability is greatly affected by the surface tension and the viscosity of the aqueous composition. Ink-jet inks suitable for use with ink-jet printing systems may have a surface tension in the range from 20 to 60, preferably from 30 to 50 dynes/cm. Control of surface tensions in aqueous inks may be accomplished by additions of small amounts of surfactants. The level of surfactants to be used can be determined through simple trial and error experiments. Several anionic and nonionic surfactants are known in the ink-jet art. Commercial surfactants include the SYRFINOL TM series, trade name from Air Products; the ZONYL TM series, trade name from DuPont; the FLUORAD TM series, trade name from 3M, and the AEROSOL TM series, trade name from Cyanamid.

Furthermore the ink may comprise one or more compounds which are able to increase the resistance towards the solubilizing effect of the aqueous alkaline developer. Such compounds may be selected from following classes:

(a) compounds which include a polyalkyleneoxide unit;
(b) siloxanes, and
(c) esters, ethers, and amides of polyhydric alcohols.

More details can be found in WO 99/21725.

The viscosity of the ink is preferably not greater than 20 mPa.s, e.g. from 1 to 10, preferably from 1 to 5 mPa.s at room temperature.

The ink may further comprise other ingredients. A biocide may be added to prevent unwanted microbial growth which may occur in the ink over time. Additional additives that may be optionally present in the ink include thickeners, pH adjusters, buffers, conductivity enhancing agents, drying agents, and defoamers.

In order to enhance the image contrast after jetting the image on a lithographic receiver, dyes can be added. Many dyes and pigments are known to be suited for the ink jet technology. Suitable dyes are further selected based on their compatibility in the carrier medium (i.e. aqueous based or solvent based) and on the compatibility with the oleophilizing agent i.e. they should not lead to coagulation. Especially favoured for aqueous inks are anionic dyes such as acid black.

Composition of the Lithographic Printing Plate Precursor (a) The Lithographic Receiver The support may be any support suitable for printing plates. Typical supports include metallic and polymeric sheets or foils. Preferably, a support having a metallic surface is used. Preferably, the metallic surface is oxidised. In a particularly preferred embodiment of the invention, a support having an anodised aluminium surface is employed. The support for the lithographic printing plate is typically formed of aluminium which has been grained, for example by electrochemical graining, and then anodised, for example, by means of anodising techniques employing sulphuric acid and/or phosphoric acid. Methods of both graining and anodising are very well known in the art and need not be further described herein. After writing the image the printing plate can be inked with printing ink in the normal way, and the plate can be used on a printing press. Before inking the plate can be treated with an aqueous solution of natural gum, such as gum acacia, or of a synthetic gum such as carboxymethyl cellulose, as it is well known in the art of printing.

According to another mode in connection with the present invention the lithographic base with a hydrophilic surface comprises a flexible support, such as e.g. paper or plastic film, provided with a cross-linked hydrophilic layer. A particularly suitable cross-linked hydrophilic layer may be obtained from a hydrophilic binder cross-linked with a cross-linking agent such as formaldehyde, glyoxal, polyisocyanate, melamine type cross-linkers, ammonium zirconyl carbonate, titanate crosslinkers, or a hydrolysed tetraalkylorthosilicate. The latter is particularly preferred. As hydrophilic binder there may be used hydrophilic (co) polymers such as, for example, homopolymers and copolymers of vinyl alcohol, acrylamide, methylol acrylamide, methylol methacrylamide, acrylate acid, methacrylate acid, hydroxyethyl acrylate, hydroxyethyl methacrylate or maleic anhydride/vinylmethylether copolymers. The hydrophilicity of the (co)polymer or (co)polymer mixture used is preferably the same as or higher than the hydrophilicity of polyvinyl acetate hydrolyzed to at least an extent of 60percent by weight, preferably 80 percent by weight.

The cross-linked hydrophilic layer in a lithographic base used in accordance with the present embodiment preferably also contains substances that increase the mechanical strength and the porosity of the layer e.g. metal oxide particles which are particles of titanium dioxide or other metal oxides. It is believed that incorporation of these particles gives the surface of the cross-linked hydrophilic layer a uniform rough texture consisting of microscopic hills and valleys which serve as storage places for water in background areas. Preferably these particles are oxides or hydroxydes of beryllium, magnesium, aluminium, silicon, gadolinium, germanium, arsenic, indium, tin, antimony, tellurium, lead, bismuth, titanium or a transition metal. Particularly suitable inorganic particles are oxides or hydroxides of aluminum, silicon, zirconium or titanium, used in at most 75% by weight of the hydrophilic layer. The inorganic pigments may have a particle size ranging from 0.005$\mu$ to 10 $\mu$m.

Particular examples of suitable cross-linked hydrophilic layers for use in accordance with the present invention are disclosed in EP-A-601 240, GB-P-1 419 512, FR-P-2 300 354, U.S. Pat. Nos. 3,971,660, U.S. Pat. No. 4,284,705 and EP-A-514 490.

As flexible support of a lithographic base in connection with the present embodiment it is particularly preferred to use a plastic film e.g. substrated polyethylene terephthalate film, substrated polyethylene naphthalate film, cellulose acetate film, polystyrene film, polycarbonate film etc. The plastic film support may be opaque or transparent.

(b) The Image Forming Layer

The image forming layer is applied by coating an image forming composition which will now be explained in more detail.

The polymer binders present in the image forming composition used in accordance with the present invention are water-insoluble but alkali-soluble polymers. Preferred are polymers comprising a functional group chosen from hydroxy, carboxylic acid, amino, amido, and maleiimide. Suitable classes of compounds include copolymers of (meth) acrylic acid with alkyl(meth)acrylates, (meth)acrylic acid nitrile and the like, copolymers of cronic acid with alkyl (meth)acrylates, (meth)acrylic acid nitrile and the like, copolymers of vinyl acetic acid with alkyl(meth)acrylates, copolymers of maleic acid anhydride with optionally substituted styrenes, esters of the copolymers of maleic acid anhydride, esters of hydroxyl group containing polymers with anhydrides of di- or polycarboxylic acids, copolymers of hydroxyalkyl(meth)acrylate with alkyl(meth)acrylates, (meth)acrylic acid nitrile and the like, copolymers of allyl alcohol with optionally substituted styrenes, copolymers of vinyl alcohol with alkyl(meth)acrylates or other polymerizable unsaturated compounds, polyurethanes, in so far as they have a sufficient number of free hydroxylic groups, epoxy resins, polyester, partially hydrolized vinyl acetate copolymers, polyvinyl acetals with free hydroxyl groups.

Other preferred compounds include copolymers of 4-hydroxystyrene with 3-methyl-4-hydroxystyrene or 4-methoxystyrene, copolymers of (meth)acrylic acid with styrene, copolymers of maleiimide e.g. with styrene, hydroxy or carboxy functionalized celluloses.

Especially suitable compounds however are phenolic resins including novolac resins, resole resins and polyvinyl compounds having phenolic hydroxy groups.

Novolac resins are the most preferred type. They are generally polymers that are produced by the condensation reaction of phenols and an aldehyde, such as formaldehyde, or aldehyde-releasing compound capable of undergoing phenol-aldehyde condensation, in the presence of an acid catalyst. Typical novolac resins include, but are not limited to, phenol-formaldehyde resin, cresol-formaldehyde resin, phenol-cresol-formaldehyde resin, p-t-butylphenol-formaldehyde resin, and pyrogallol-acetone resins. Such compounds are well known and described for example in U.S. Pat. Nos. 4,308,368, 4,845,008, 5,437,952 and U.S. Pat. Nos. 5,491,046, 5,143,816 and GB 1,546,633. A particularly useful novolac resin is prepared by reacting m-cresol or phenol with formaldehyde using conventional conditions.

Phenolic resins that are known as "resole resins", including, for example, condensation products of bis-phenol A and formaldehyde, are also useful in this invention.

Still another useful phenolic binder resin is a polyvinyl compound having phenolic hydroxyl groups. Such compounds include, but are not limited to, polyhydroxystyrenes and copolymers containing recurring units of a hydroxystyrene, and polymers and copolymers containing recurring units of halogenated hydroxystyrenes. Such polymers are described for example in U.S. Pat. No. 4,845,008 (noted above).

Other useful novolacs are described in U.S. Pat. Nos. 4,306,010 and 4,306,011. Still other useful phenolic resins are described in U.S. Pat. No. 5,368,977.

A mixture of the resins described above can be used, but preferably, a single resin, e.g. a novolac is present as the binder resin in the imaging composition of this invention.

Apart from the polymeric binder soluble in an aqueous alkali developer the image forming composition may contain various additives as occasion demands. For example, cyclic acid anhydrides, phenols, organic acids, and a sulfonyl compound can be used in order to improve the aqueous alkaline developability.

Examples of the cyclic acid anhydride include phthalic anhydride, tetrahydrophthalic anhydride, hexahydrophthalic anhydride, 3,6-endoxy-$\Delta^4$-tetrahydrophthalic anhydride, tetrachlorophthalic anhydride, maleic anhydride, chloromaleic anhydride, $\alpha$-phenylmaleic anhydride, succinic anhydride, and pyromellitic anhydride, as described in U.S. Pat. No. 4,115,128.

Examples of the phenols include bisphenol A, p-nitrophenol, p-ethoxyphenol, 2,4,4'-trihydroxybenzophenone, 2,3,4-trihydroxybenzophenone, 4-hydroxybenzophenone, 4,4',4"-trihydroxytriphenylmethane, and 4,4',3",4"-tetrahydroxy-3,5,3',5'-tetramethyltriphenylmethane, and the like.

Examples of the organic acids include sulfonic acids, sulfinic acids, alkylsulfuric acids, phosphonic acids, phosphates, and carboxylic acids, as described in, for example, JP-A Nos. 60-88,942 and 2-96,755. Concrete examples of these organic acids include p-toluenesulfonic acid, dodecylbenzenesulfonic acid, p-toluenesulfin acid, ethylsulfuric acid, phenylphosphonic acid, phenylphosphinic acid, phenyl phosphate, diphenyl phosphate, benzoic acid, isophthalic acid, adipic acid, p-toluic acid, 3,4,-dimethoxybenzoic acid, 3,4,5-trimethoxybenzoic acid, phthalic acid, terephthalic acid, 4-cyclohexene-1,2-dicarboxylic acid, erucic acid, lauric acid, n-undecanoic acid, ascorbic acid, bishydroxyphenylsulfone, methylphenylsulfone, diphenyldisulfone, and the like.

The amount of the cyclic acid anhydride, phenol, or organic acid contained in the image forming composition is preferably in the range of 0.05 to 20% by weight.

Furthermore the image forming composition may additionally comprise nonionic and/or amphoteric surfactants. Specific examples of the nonionic surfactant include sorbitan tristearate, sorbitan monopalmitate, sorbitan trioleate, stearic acid monoglyceride, polyoxyethylene nonylphenyl ether, and the like. Specific examples of the amphoteric surfactant include alkyldi(aminoethyl)glycine, hydrochloric acid salt of alkylpolyaminoethylglycine, 2-alkyl-N-carboxyethyl-N-hydroxyethylimidazolinium betaine, N-tetradecyl-N,N-betaine, for example, AMOGEN K, trade name of Dai-ichi Kogyo Seiyaku Co., and the like.

Dyes can be added in a small amount to adjust the plate color. Specific examples of these dyes include Oil Yellow No. 101, Oil Yellow No. 103, Oil Pink No. 312, Oil Green BG, Oil Blue BOS, Oil Blue No. 603, Oil Black BY, Oil Black BS, Oil Black T-505 (all trade names of Chemical Industries, Co.,), Victoria Pure Blue, Crystal Violet (C.I. 42555), Methyl Violet (C.I. 42535), Ethyl Violet, Rhodamine B (C.I. 145170B), Malachite Green (C.I. 42000), Methylene Blue (C.I. 52015), and the like.

Further, if necessary, a plasticizer may be added to the negative-type image forming composition of the present invention in order to impart flexibility to the coated layer. Examples of the plasticizer include butyl phthalyl, polyethylene glycol, tributyl citrate, diethyl phthalate, dibutyl[]phthalate, dihexyl phthalate, dioctyl phthalate, tricresyl phosphate, tributyl phosphate, trioctyl phosphate, tetrahydrofurfuryl oleate, an oligomer or a polymer of acrylic acid or methacrylic acid, and the like.

Further, if necessary, a compound which is decomposed by light, such as quinonediazides or diazo compounds, may be added to the image forming composition. The amount of the compound added to the composition is preferably in the range of 1 to 10% by weight based on the total weight of the solids of the composition.

In order to control the dot formation on the imaging layer an additional top receiving layer may be applied. This layer should not disturb the processing characteristics. Therefore the thickness of the layer should be less than 1 $\mu$m, preferably less than 0.5 $\mu$m. Any polymer capable of reducing the dot size of a water based ink jet ink can be used. Especially favoured are water-soluble polymers such as polyvinyl alcohol, polyvinyl pyrrolidone, cellulose derivatives, dextranes, etc. Such polymers may also anionically or cationically modified. Both modifications are preferred over the non-modified compounds.

The Ink Jet Printing Process, and the Development

The image-wise ink jet printing step (2) of the present invention can be performed by any of the known ink jet techniques, as briefly explained hereinafter.

In ink jet printing tiny drops of ink fluid are projected directly onto an ink receptor surface without physical contact between the printing device and the receptor. The printing device stores the printing data electronically and controls a mechanism for ejecting the drops image-wise. Printing is accomplished by moving the print head across the paper or vice versa. Early patents on ink jet printers include U.S. 3,739,393, 3,805,273 and 3,891,121.

The jetting of the ink droplets can be performed in several different ways. In a first type of process a continuous droplet stream is created by applying a pressure wave pattern. This process is known as continuous ink jet printing. In a first embodiment the droplet stream is divided into droplets that are electrostatically charged, deflected and recollected, and into droplets that remain uncharged, continue their way undeflected, and form the image. Alternatively, the charged deflected stream forms the image and the uncharged undeflected jet is recollected. In this variant of continuous ink jet printing several jets are deflected to a different degree and thus record the image (multideflection system).

According to a second process the ink droplets can be created "on demand" ("DOD" or "drop on demand" method) whereby the printing device ejects the droplets only when they are used in imaging on a receiver thereby avoiding the complexity of drop charging, deflection hardware, and ink recollection. In drop-on-demand the ink droplet can be formed by means of a pressure wave created by a mechanical motion of a piezoelectric transducer (so-called "piezo method"), or by means of discrete thermal pushes (so-called "bubble jet" method, or "thermal jet" method).

In the present invention the printing plate precursor is image-wise ink jet printed (step 2) with the particular fluid described.

It is a particular advantage of the present invention that only a relatively inexpensive ink jet apparatus is required instead of an expensive platesetter device for the heat-sensitive printing plate precursors.

After image-wise printing the printing plate precursor is dried (step 3) to at least partially remove the solvent carrier of the fluid. Then the printing plate precursor is treated with an aqueous alkaline developer (step 4). By aqueous alkaline developers is meant positive- and negative developers for conventional plates as known to the expert in the field. The pH may range from neutral (pH=7) to strong alkaline (pH=14). An example of a negative developer is OZASOL EN 223 (trade name of Agfa-Gevaert N.V.); examples of positive developers are OZASOL EP26, OZASOL EP 262A, OZASOL EP 240, and GB50 (all trade names of Agfa-Gevaert N.V.).

Due to the solubility of the polymeric binder in the aqueous alkaline developer the non-imaged areas are completely removed and the hydrophilic lithographic support is revealed. On the other hand, due to the action of the dissolution inhibitor the imaged areas are not at all or only partially removed so that they can function as ink-accepting areas in a printing process. After optional rinsing and gumming, the final result is a negative working printing plate with the plate characteristics of a conventional plate. Since the image forming layer does not contain photochemical compounds which might influence the aqueous alkaline developer stability of the binder upon UV-exposure the whole process can be performed in a daylight environment.

The present invention will now be illustrated by the following examples without however being limited thereto.

EXAMPLES

Example 1

Preparation of the Printing Plate Precursor 50.3 g of tetrahydrofuran was mixed with 18.8 g of ALVANOL SPN452 (40% solution of novolac resin in DOWANOL PM; commercially available from Clariant), 29.9 g of DOWANOL PM and 1.02 g of 3,4,5-trimethoxybenzoic acid. DOWANOL PM is 1-methoxy-2-propanol (registered trade mark of Dow Co.).

This solution was coated onto a grained and anodised aluminium support at a wet coating thickness of 14 um resulting in a dry image forming composition of 1.1 g/m$^2$.

Preparation of the Fluid

The fluid was prepared by dissolving 1 g of Flexo Blue 630 (trade name from BASF AG) in a mixture of 70 g of water and 30 g of isopropanol. After filtering the solution was loaded into the ink cartridge of an Epson STYLUS COLOR 900 (trade mark of Epson Co.) ink-jet printer, the cartridge having previously been emptied and cleaned.

A test pattern containing a text image was jetted onto the image forming which had been loaded into the Epson Stylus Color 900 ink-jet printer.

Next the plate was dipped for 15 seconds in a GB50 developer solution at 20° C. Then the plate was rinsed with water and gummed with OZASOL RC795 (registered trade mark of Agfa-Gevaert N.V.). The non-imaged areas of the image layer composition were removed from the lithographic support, resulting in a negative working printing plate.

Next the plate was mounted on a Heidelberg GTO52 lithographic printing press using K+E800 SKINNEX BLACK (available from BASF AG) as ink, and Rota-Matic (available from Unigrafica GmbH) as fountain. Excellent copies were obtained.

Example 2

Example 1 was repeated except that on top of the image forming layer of the printing plate precursor a dextrane layer was coated of 0.5 g/m$^2$ to control the dot spreading characteristics.

The fluid from example 1 was used and loaded into the ink cartridge of an Epson Stylus Color 900 ink-jet printer, the cartridge having previously been emptied and cleaned.

A test pattern containing a text image was jetted onto the image forming which had been loaded into the Epson Stylus Color 900 ink-jet printer.

Next the plate was dipped for 15 seconds in a GB50 developer solution at 20° C. Then the plate was rinsed with water and gummed with OZASOL RC795. The non-imaged areas of the image layer composition were removed from the lithographic support, resulting in a negative working printing plate.

Next the plate was mounted on a Heidelberg GTO52 lithographic printing press using K+E800 SKINNEX BLACK as ink and Rota-Matic as fountain. Excellent copies were obtained.

Example 3

The aqueous developer reducing capacity of various "dissolution inhibiting compounds" was tested using the following procedure.

The "dissolution inhibiting compound" was dissolved in a solvent carrier at a concentration of 1%. Next a 6 $\mu$l droplet of the fluid was jetted on the printing plate precursor as defined in example 1. The droplet was dried at 50° C. in order to remove the solvent carrier of the fluid. Next the plate was dipped for 10 seconds in a GB50 developer solution at 20° C. Then the plate was rinsed with water.

If the droplet-area of the image forming layer is not dissolved in the developer, the compound is suitable for use in this invention.

| Compound | Solvent carrier | Droplet-area remains on the lithographic support |
|---|---|---|
| Flexo Blue 630 | IPA 30/water 70 | Yes |
| Crystal Violet | IPA 30/water 70 | Yes |
| Tegoglide 410 | IPA 30/water 70 | Yes |
| Tegoprotect 5001 | IPA 30/water 70 | Yes |
| α-Naphtoflavone | IPA 30/water 70 | Yes |
| Xanthone | IPA 30/water 70 | Yes |
| Benzophenone | IPA 30/water 70 | Yes |
| Acridine Orange Base | IPA 30/water 70 | Yes |
| PEG2000 | IPA 30/water 70 | Yes |

*Tegoglide 410 : a polyether siloxane copolymer, wherein the polyether consists of ethylene glycol and propylene glycol units;
**Tegoprotect 5001 : hydroxy-functional silicone polyacrylate; both trade names of Tego Chemie Service GmbH, Essen Germany.

It is clear from the table that all tested compounds are suitable dissolution inhibiting compounds.

What is claimed is:

1. A method for the preparation of a negative working lithographic printing plate, said method comprising the following steps, in order, (1) providing a lithographic printing plate precursor comprising a lithographic support and an image forming layer containing a polymeric binder soluble in an aqueous alkaline developer, (2) dispensing image-wise by means of ink jet printing droplets of a fluid onto the surface of said lithographic printing plate precursor, characterized in that said fluid comprises in a solvent carrier a dissolution inhibitor compound capable of reducing the solubility in said aqueous alkaline developer of said polymeric binder, (3) drying the imaged lithographic printing plate precursor to at least partially remove the solvent carrier of the fluid, (4) treating the dried imaged lithographic printing plate precursor with an aqueous alkaline developer thereby removing the non-imaged areas wherein said dissolution inhibitor compound is selected from a group consisting of a compound having a keto group, a N-quaternized triarylmethane dye, a tetraalkly ammonium compound and a N-quaternized N-containing heterocyclic compound.

2. A method according to claim 1 wherein said compound having a keto group is selected from the group consisting of a xanthone, a flavanone, a flavone, a 2,3-diphenyl-1-indenone, a pyrone, a thiopyrone, and a 1'-(2'-acetonaphtyl) benzoate.

3. A method according to claim 1 wherein said N-quaternized N-containing heterocyclic compound is selected from the group consisting of imidazolinium compounds, quinolinium compounds, benzthiazolium compounds, and pyridinium compounds.

4. A method according to claim 3 wherein said quinolinium or benzthiazolium compounds are cationic cyanine dyes.

5. A method according to claim 1 wherein said fluid further comprises a compound selected from following classes:

(a) compounds which include a polyalkyleneoxide unit, (b) siloxanes, and (c) esters, ethers, and amides of polyhydric alcohols.

6. A method according to of claim 1 wherein said polymeric binder soluble in an aqueous alkaline developer comprises a functional group selected from hydroxyl, carboxylic acid, amino, amido, and maleiimide.

7. A method according to claim 6 wherein said polymeric binder soluble in an aqueous alkaline developer and comprising a hydroxyl functional group is a phenolic resin.

8. A method according to claim 7 wherein said phenolic resin is a novolac resin.

9. A method according to claim 1 wherein said dissolution inhibitor compound is present in said fluid in an amount ranging from 0.1% to 8% by weight.

10. A method according to claim 1 wherein said lithographic printing plate precursor further comprises a hydrophilic top layer removable in said aqueous alkaline developer.

11. A method according to claim 10 wherein said hydrophilic top layer comprises a polymer selected from the group consisting of dextrane, polyvinyl alcohol, polyvinyl pyrrolidone, and cellulose and cellulose derivatives.

12. A method according to claim 10 wherein said imaging layer and said top layer do not contain photochemical compounds capable of influencing the aqueous alkaline developer solubility of said polymeric binder upon UV-exposure.

13. A method according to of claim 1 wherein the surface of said lithographic support is metallic.

14. A method according to claim 13 wherein said metallic surface is a grained and anodized aluminum surface.

15. A method according to claim 1 wherein said lithographic support comprises a polymeric resin support and a crosslinked hydrophilic layer.

16. A method according to claim 15 wherein said crosslinked hydrophilic layer comprises an inorganic pigment.

17. A method according to claim 16 wherein said inorganic pigment is chosen from an oxide or hydroxide of beryllium, magnesium, aluminum, silicon, gadolinium, arsenic, indium, tin, antimony, tellurium, lead, bismuth, titanium or a transition metal.

* * * * *